US005653646A

United States Patent [19]

Negishi et al.

[11] Patent Number: 5,653,646

[45] Date of Patent: Aug. 5, 1997

[54] GOLF CLUB SHAFT AND METHOD OF PRODUCING THE SAME

[75] Inventors: Isamu Negishi, Iwatsuki; Tetsuto Minowa, Haramachi, both of Japan

[73] Assignee: Fujikura Rubber Ltd., Tokyo, Japan

[21] Appl. No.: 547,722

[22] Filed: Oct. 26, 1995

[30] Foreign Application Priority Data

Oct. 28, 1994 [JP] Japan ..... 6-289148

[51] Int. Cl.[6] ..... A63B 53/10

[52] U.S. Cl. ..... 473/319; 273/DIG. 23

[58] Field of Search ..... 473/316, 319; 273/DIG. 23, 80 R, 80.5, 80.9

[56] References Cited

U.S. PATENT DOCUMENTS

| | | | |
|---|---|---|---|
| 3,646,610 | 2/1972 | Jackson | 473/319 |
| 4,539,253 | 9/1985 | Hirschbuehler | 428/229 |
| 4,889,575 | 12/1989 | Roy | 473/319 |
| 4,957,883 | 9/1990 | Kobayashi | 507/35 |
| 5,083,780 | 1/1992 | Walton | 273/DIG. 23 |
| 5,143,374 | 9/1992 | Shibasaki | 273/DIG. 7 |
| 5,538,769 | 7/1996 | Sandman, Jr. | 428/36.3 |

*Primary Examiner*—Sebastiano Passaniti
*Assistant Examiner*—Stephen Luther Blau
*Attorney, Agent, or Firm*—Koda and Androlia

[57] ABSTRACT

A golf club shaft is composed of a fiber layer formed by employing a filament winding process using filaments each impregnated with a thermosetting resin, and a reinforcement layer formed by partially inserting a braid impregnated with a thermosetting resin onto a predetermined position on the fiber layer. A method of producing a golf club shaft of the foregoing type comprises a step of winding filaments each impregnated with a thermosetting resin around a mandrel to form a fiber layer, a step of inserting a braid composed of filaments each impregnated with a thermosetting resin onto a predetermined position on the fiber layer, a step of allowing the thermosetting resin to be thermally cured, and a step of disconnecting the mandrel.

5 Claims, 2 Drawing Sheets

GOLF CLUB SHAFT AND METHOD OF PRODUCING THE SAME

BACKGROUND OF THE INVENTION

1. Field of the Invention

The present invention relates generally to a golf club shaft and a method of producing the same. More particularly, the present invention relates to a golf club shaft of which kick point position can be adjusted as desired and a method of producing a golf club shaft of the foregoing type of which kick point position can easily be adjusted without any deterioration of properties of the golf club shaft.

2. Statement of the Related Art

A golf club shaft has been variously improved from the viewpoints that the ball flying distance is elongated, the locus of ball flying is changed, and the directionality of flying of the ball is stabilized.

A variety of researching activities have been conducted with respect to a kick point of the golf club shaft i.e., a position where the golf club shaft easily flexes. For example, when the kick point of the golf club shaft is located on the head side (tip side), the ball is easy to fly highly, and the high locus of flying of the ball is easily described. On the other hand, when it is located on the grip side (butt side), the directionality of flying of the ball is stabilized. Since the aforementioned facts are clarified, the kick point of the golf club shaft has been changed in a various manner. Various methods are thinkable as a method of adjusting the position of the kick point. One of the methods is a filament winding method, i.e., a method of producing a golf club shaft wherein filaments each impregnated with a thermosetting resin are wound around a mandrel at a predetermined angle, and thereafter, the thermosetting resin is cured. With respect to the foregoing method, there is known a method of adjusting the kick point by changing the angle for winding the filaments at the kick point position so as to allow them to be easily bent (an angle of θ shown in FIG. 3 to be described later is set to 20° on the butt side as well as on the tip side and it is set to about 40° at the position in the vicinity of the kick point). In this case, there arises a drawback that a bending strength of each filament becomes weak in the region where the foregoing angle has been changed.

A golf club shaft having its kick point changed by forming a fiber layer by filament winding, and thereafter, forming a reinforcement layer by partial sheet winding is disclosed (refer to Japanese Utility Model Laid-Open Publication No. 63-133261).

Such golf club shaft is produced by forming a fiber layer 2 by winding filaments around a mandrel 1, and thereafter, Partially winding a reinforcement layer 3 on the fiber layer 2 by employing a sheet winding process, moreover, forming a fiber layer (not shown) along the whole length of the reinforcement layer 3, and subsequently, allowing the plural layers to be cured and then disconnecting the mandrel 1.

With the golf club shaft produced in that way, since the reinforcement layer 3 is formed by employing the sheet winding process, there arises a drawback that a joint portion for the reinforcement layer is formed about the circumferential part and the golf club shaft exhibits directionality attributable to the presence of the joint portion. In addition, since filaments are wound around the reinforcement layer 3 again after a sheet is wound around the reinforcement layer 2, there arises other drawback that a filament winding machine should be installed together with a mandrel with many manhours and machinehours.

With the structure that the reinforcement later formed by sheet winding is located at the outermost layer, when a grinding operation is performed, a part of the reinforcement layer is ground, resulting in a reinforcement effect being reduced.

To eliminate the foregoing drawback, a method of producing a golf club shaft by forming a reinforcement layer merely by employing a filament winding process has been discussed. Specifically, this method is practiced such that as shown in FIG. 4, after a fiber layer 2 is formed around the a mandrel 1 by employing a filament winding process, a reinforcement layer 3 is partially formed by the filament winding process prior to curing, moreover, filament winding is performed over the whole length, thereafter, these layers are cured, and then, the mandrel 1 is disconnected.

With such method, since the reinforcement layer can be obtained merely by employing the filament winding process, this method is practicable. However, as shown in FIG. 4, due to a necessity for winding filaments by several turns on the opposite ends of the reinforcement layer 3 under a condition that the winding angle of θ as shown in FIG. 3 is set to 90° (in order to prevent the wound filaments from becoming loose), there arises another drawback that a raised portion 31 is formed. In addition, there arises another drawback that a boundary 4 between the reinforcement layer 3 and the fiber layer 2 has a reduced diameter because of the filament winding performed when the reinforcement layer 3 is formed. Thus, a large stepped part is formed between the reinforcement layer 3 and the fiber layer 2. Because of the presence of the large stepped Part, in practice, the golf club shaft can not be sold as a commercial good.

SUMMARY OF THE INVENTION

The present invention has been made in consideration of the aforementioned background.

An object of the present invention is to provide a golf club shaft which assures that a reinforcement layer is disposed without any formation of a stepped part by basically employing a filament winding process and which makes it possible to adjust the position of a kick point. Another object of the present invention is to provide a method of producing a golf club shaft of the foregoing type.

According to other aspect of the present invention, there is provided a method of producing a golf club shaft of the foregoing type which comprises a step of winding filaments each impregnated with a thermosetting resin around a mandrel to form a fiber layer, a step of inserting a braid composed of filaments each impregnated with a thermosetting resin onto said mandrel and locating the braid at a predetermined position said fiber layer; a step of allowing the thermosetting resin to be cured, and a step of disconnecting the mandrel.

According to the present invention, since the braid is used as a reinforcement layer, a golf club shaft of which kick point can simply be adjusted can be provided without any formation of a stepped part.

DESCRIPTION OF THE PREFERRED EMBODIMENT

The present invention will now be described in detail hereinafter with reference to the accompanying drawings which illustrate a preferred embodiment thereof.

Figure 1:
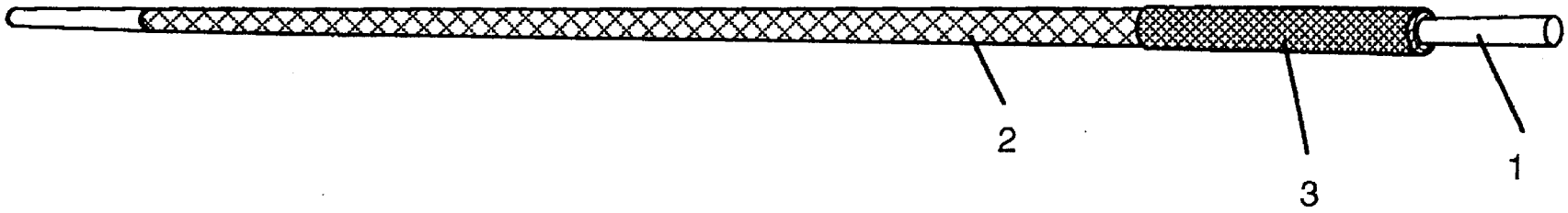
FIG. 1 is a perspective view of a golf club shaft constructed in accordance with an embodiment of the present invention.
Figure 2:
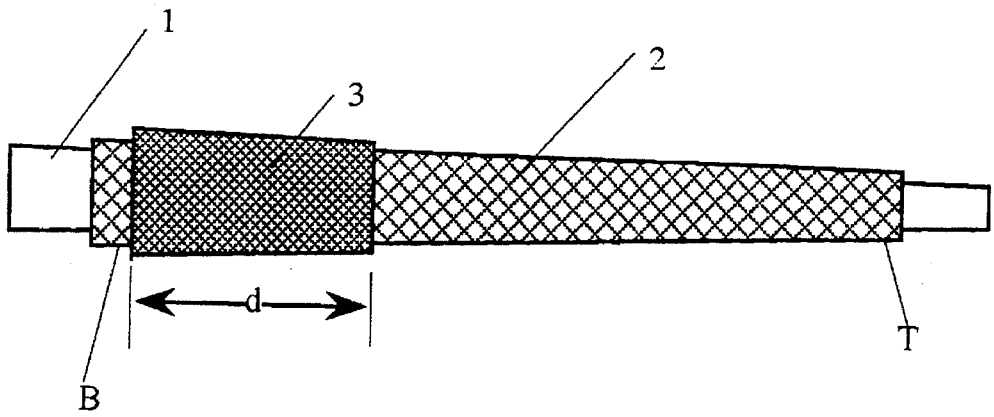
FIG. 2 is a side view of the golf club shaft of the present invention, showing an intermediate step during production of the golf club shaft.

As shown in FIG. 2, a golf club shaft of the present invention is constructed such that a reinforcement layer 3 is placed on a shaft main body composed of a fiber layer 2, in the case shown in FIG. 2, the reinforcement layer 3 is located the butt side. However, the present invention should not be limited only to this. Alternatively, the reinforcement layer 3 may be located on the tip side. In the case that plural fiber layers are formed, the reinforcement layer is not necessarily located on the uppermost layer but it can be located on an arbitrary layer.

It is preferable that a length d of the reinforcement layer 3 ranges from 200 to 500 mm. When the length d of the reinforcement layer 3 is less than 200 mm, there is a fear that the position of a kick point can not be adjusted. On the other hand, when the length d of the reinforcement layer 3 exceeds 500 mm, bending rigidity of the shaft as measured from the butt side to the vicinity of the kick point is increased with the result that it becomes difficult that the golf club shaft is bent.

Figure 3:
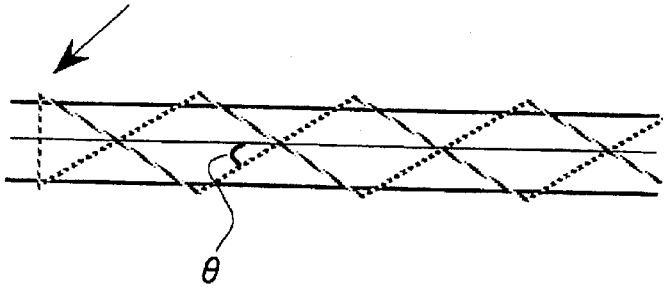
FIG. 3 is a schematic view which explains a winding angle when filaments are wound around a mandrel.
Figure 4:
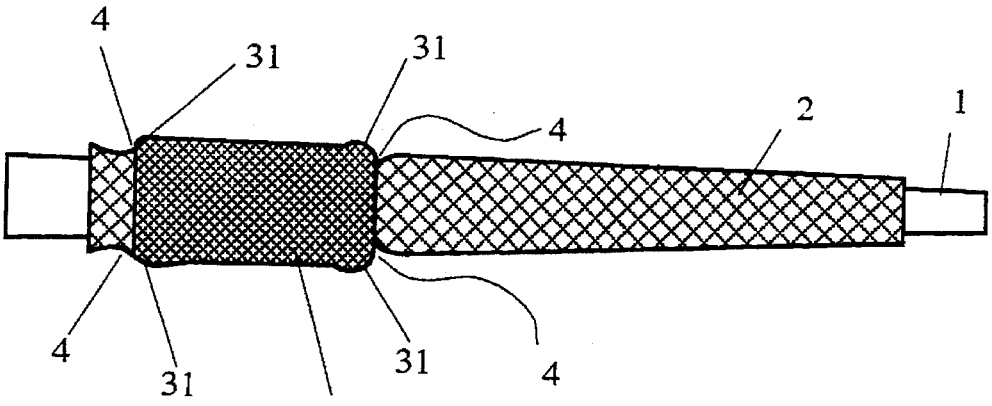
FIG. 4 is a side view of a golf club shaft which explains an intermediate step during production of the golf club shaft.

It is preferable that a winding angle θ (see FIG. 3) of the braid constituting the reinforcement layer 3 ranges from 5° to 30°. When it is less than 5°, it is difficult to knit the braid, and moreover, when it is cut to a predetermined length, the end parts of filaments become loose. On the other hand, when it exceeds 30°, a component in the 0° direction is reduced, and the braid does few contribute to the bending rigidity of the golf club shaft. This, there arises a drawback that a reinforcement effect is reduced.

In addition, it is preferable that a (filament) count of each yarn constituting the braid ranges from 3K to 6K (1K=1000 filaments). When it is smaller than 3K, there is a fear that filaments become expensive. On the other hand, when it exceeds 6K, there is a fear that a stepped part is formed between the reinforcement layer and the fiber layer.

It is preferable that the number of yarns per said braid is in a range from 24 to 72 pieces. When it is smaller than 24 pieces, the braid exhibits few reinforcing effect. On the other hand, when it exceeds 72 pieces, a thickness of the braid is increased, and there is a fear that a stepped part is formed between the reinforcement layer and the fiber layer.

As filaments constituting the braid, filaments usable for producing a conventional golf club shaft can effectively be used. For example, carbon fiber, alumina fiber, silicon-titan-carbon-oxygen fiber (TYRANO FIBER;™), metallic fiber, glass fiber, polyamide fiber and mixed fibers composed of two or more kinds of the foregoing fibers can effectively be used.

A braid available in a commercial market can be used for the braid. Otherwise, a braid is built on the mandrel by employing a filament winding process, and after a mandrel is drawn, the braid can be used by cutting it to a predetermined length. A golf club shaft can effectively be produced merely by using a filament winding apparatus. A three-dimensional fabric (cylindrical) can be used as a braid.

Next, description will be made below with respect to a method of producing a golf club shaft. First, as shown in FIG. 2, filaments each impregnated with a thermosetting resin are wound around a mandrel to form a fiber layer 2.

Then, a braid 3 impregnated with a thermosetting resin and preliminarily constructed with a predetermined width, a predetermined angle, a predetermined size and a predetermined number of struck filaments is inserted from the fore end on the tip side of the mandrel so that it is placed at a predetermined location. Thereafter, a fiber layer may be laminated on the braid.

After the braid is placed in that way, the impregnated thermosetting resin is heated and cured, and subsequently, the mandrel is disconnected to provide a golf club shaft.

Next, a few examples of the golf club shaft of the present invention will be described below. These example are merely illustrative and they do not define the technical scope of the present invention.

EXAMPLES

Carbon fibers 12K (12000 filaments) each having a tensile modulus of 24 t/mm$^2$ and impregnated with epoxy resin were wound on a mandrel with an angle 40°/20°/15° relative to the center line of the mandrel to form a fiber layer. In this process, a braid having the number of 48 of struck carbon fibers 3K (3000 filaments) each having a tensile modulus 24 t/mm$^2$ and impregnated with an epoxy resin (length d=400 mm, winding angle θ=30°) was inserted between 20°/15° or 40°/20° of the fiber layer of the shaft on the butt side or the tip side to form a reinforcement layer. Thereafter, tape was wounded and the epoxy resin was heated and cured, and after the mandrel was drawn, a grinding operation was performed to provide a golf club shaft.

Results derived from measurement are shown on Table 1. Incidentally, a comparative example shows a golf club shaft which was produced in the same winding manner as mentioned above without any reinforcement layer. In the table, Kp point (%)=($T_1$/1)×100 ($T_1$ shows a distance between a tip top end $T_0$ and a kick point Kp and l shows a length of the shaft). A numeral located behind T like T100 and T800 shows the position corresponding to the distance (mm) from the tip top end $T_0$. For example, the case of T100 shows that measurements were conducted at the position located away from the tip by a distance of 100 mm. In addition, B means a butt (see FIG. 2).

TABLE 1

| | No. 1 | | No. 2 | | No. 3 | |
|---|---|---|---|---|---|---|
| | example | comparative example | example | comparative example | example | comparative example |
| mandrel | A | ← | B | ← | C | ← |
| reinforcement layer | $B^0$~B450 | none | $T^0$~T450 | none | $B^0$~B450 | none |
| position of the same | between 20°~5° | — | between 20°~5° | — | between 40°~20° | — |
| ϕT100 mm | 9.21 | 9.12 | 9.28 | 8.82 | 9.12 | 8.90 |
| ϕT800 mm | 15.23 | 14.76 | 14.64 | 14.55 | 14.88 | 14.50 |
| weight g | 92 | 84 | 87 | 83 | 91 | 85 |
| I = 1050 mm | | | | | | |
| bend mm iron | 36 | 40 | 39 | 39.5 | 34 | 38 |
| torque degree | 2.22 | 2.35 | 2.13 | 2.33 | 2.19 | 2.23 |

TABLE 1-continued

| | No. 1 | | No. 2 | | No. 3 | |
|---|---|---|---|---|---|---|
| | example | comparative example | example | comparative example | example | comparative example |
| Kp T/B process | | | | | | |
| before grinding | 1.66 | 1.50 | 1.42 | 1.50 | 1.64 | 1.46 |
| after grinding | 1.78 | 1.59 | 1.48 | 1.62 | 1.80 | 1.55 |
| Kp point | | | | | | |
| $T^1$ | T471 | T493 | T507 | T488 | T475 | T506 |
| % | 44.8 | 47.0 | 48.3 | 46.5 | 45.2 | 48.2 |
| CPM | 350 | 334 | 336 | 333 | 355 | 336 |
| time/minute | | | | | | |
| 38.5 inch | | | | | | |
| 236 g | | | | | | |
| tune | top | middle | butt | middle | top | middle |
| T/B process KP | | | 1.2~1.5~1.7~2.0 | | | |
| iron | | tune at top | tune at middle | | tune at butt | |

Table 2 shows a rate of 0° component (0° component percentages=(0° component/0° component+90° component) ×100) at the winding angle of the braid corresponding to each winding angle, and the 0° component and the 90° component show vectors, respectively.

TABLE 2

| angle of cylindrically knitted fabric ~0° component rate | | | | | |
|---|---|---|---|---|---|
| angle of braid | 10° | 20° | 30° | 40° | 50° |
| 0° component | 0.98 | 0.94 | 0.86 | 0.76 | 0.64 |
| 90° component | 0.17 | 0.34 | 0.50 | 0.64 | 0.76 |
| 0° + 90° component total | 1.15 | 1.28 | 1.36 | 1.40 | 1.40 |
| 0° component percentage % | 85 | 73 | 63 | 54 | 46 |

As is apparent from Table 2, when the angle of the braid exceeds 30°, the 0° component percentages become small which contributes to bending rigidity of the shaft. Thus, there arises a drawback that a reinforcement effect of the braid becomes small.

Table 3 shows golf culb shaft when the angle of the braid corresponding to Sample No. 1 in Table 1 is changed. As is apparent from Table 3, when the angle of the braid is enlarged, the Kp point does not vary so much.

TABLE 3

| golf club shaft data wherein braid was used for reinforcement of butt | | | |
|---|---|---|---|
| Kp T/B process | 1.78 | 1.53 | 1.59 |
| Kp point | T471 | T493 | T493 |
| | 44.8% | 47.0% | 47.0% |
| reinforcement angle of braid | 30° | 50° | no reinforcement |

As described above, with the golf club shaft and the producing method of the present invention, by partially improving the rigidity of the shaft, the kick point for the whole shaft can be changed, and by forming the reinforcement layer, there does not arise a stepped part. Thus, an obtainable advantage is that it is possible to produce a golf club shaft by basically employing a filament winding process.

What is claim is:

1. A golf club shaft comprising:

a fiber layer formed by employing a filament winding process using filaments each impregnated with a thermosetting resin, a reinforcement layer formed by partially inserting a preliminarily formed braid impregnated with a thermosetting resin onto a predetermined position on said fiber layer, said braid having a winding angle range from 5 to 30 degrees, a (filament) count of each yarn ranges from 3K to 6K and a number of yarns per said braid ranges from 24 to 72, and after tape winding on said fiber layer and reinforcing layer, said thermosetting resin is thermally cured with no stepped part formed between said reinforcement layer and said fiber layer.

2. The golf club shaft as claimed in claim 1, wherein a length of said reinforcement layer ranges from 200 to 500 mm.

3. A method of producing a golf club shaft, comprising:

a step of winding filaments each impregnated with a thermosetting resin around a mandrel to form a fiber layer, a step of inserting a braid composed of filaments each impregnated with a thermosetting resin and locating said braid at a predetermined position on said fiber layer, said braid having a winding angle range from 5 to 30 degrees, a (filament) count of each yarn ranges from 3K to 6K and a number of yarns per said braid ranges from 24 to 72, a step of winding tape on said fiber layer and reinforcing layer, a step of allowing said thermosetting resin to be cured with no stepped part formed between said reinforcement layer and said fiber layer, and a step of disconnecting said mandrel.

4. The method of producing a golf club shaft as claimed in claim 3, wherein a length of said braid ranges from 200 to 500 mm.

5. The method of producing a golf club shaft as claimed in 3 or 4, wherein filaments are wound around a mandrel by employing a filament winding process to build a braid, and after said mandrel is drawn, said braid is cut to a predetermined length.

* * * * *